US009303938B2

(12) United States Patent
Hiscock

(10) Patent No.: US 9,303,938 B2
(45) Date of Patent: Apr. 5, 2016

(54) BLANK CHAMBER AND HOUSING

(71) Applicant: Jason P. Hiscock, Indianapolis, IN (US)

(72) Inventor: Jason P. Hiscock, Indianapolis, IN (US)

(73) Assignee: Jason P. Hiscock, Indianapolis, IN (US)

( * ) Notice: Subject to any disclaimer, the term of this patent is extended or adjusted under 35 U.S.C. 154(b) by 176 days.

(21) Appl. No.: 13/974,680

(22) Filed: Aug. 23, 2013

(65) Prior Publication Data

US 2015/0033934 A1 Feb. 5, 2015

Related U.S. Application Data

(60) Provisional application No. 61/859,831, filed on Jul. 30, 2013.

(51) Int. Cl.

| | |
|---|---|
| ***F41A 33/00*** | (2006.01) |
| ***F41A 21/12*** | (2006.01) |
| ***F41A 21/26*** | (2006.01) |
| ***F41A 33/04*** | (2006.01) |

(52) U.S. Cl.

CPC ..... *F41A 21/12* (2013.01); *F41A 21/26* (2013.01); *F41A 33/04* (2013.01)

(58) Field of Classification Search

CPC ..... F41A 33/00; F41A 33/06; F41A 21/00; F41A 21/10; F41A 21/26; F41C 23/12; F41C 23/00

USPC ..... 89/29, 193; 42/76.01, 77; 434/16, 18

See application file for complete search history.

(56) References Cited

U.S. PATENT DOCUMENTS

| | | | | |
|---|---|---|---|---|
| 1,396,949 | A | 11/1921 | Eickhoff | |
| 1,425,810 | A | 8/1922 | Thompson | |
| 2,053,489 | A | 9/1936 | Norman | |
| 4,335,643 | A | 6/1982 | Gal | |
| 4,829,877 | A * | 5/1989 | Zerega | 89/14.5 |
| H000926 | H * | 6/1991 | Mahtook | 89/128 |
| 5,585,589 | A * | 12/1996 | Leiter | 89/128 |
| 5,675,106 | A * | 10/1997 | Leiter | 89/14.5 |
| 5,829,180 | A * | 11/1998 | Leiter | 42/77 |
| 6,848,208 | B1 * | 2/2005 | Kirschner | 42/77 |
| 7,380,363 | B1 * | 6/2008 | Kirschner | 42/76.01 |
| 7,621,210 | B2 * | 11/2009 | Fluhr et al. | 89/193 |
| 7,926,405 | B2 * | 4/2011 | Ducastel, Jr. | 89/29 |
| 7,942,090 | B1 * | 5/2011 | Hoffman | 89/29 |

(Continued)

FOREIGN PATENT DOCUMENTS

| | | | | |
|---|---|---|---|---|
| DE | 3733216 A1 * | 4/1989 | | F41C 21/12 |
| GB | 2345122 A * | 6/2000 | | F41A 21/26 |

*Primary Examiner* — Benjamin P Lee

(74) *Attorney, Agent, or Firm* — E. Victor Indiano; Indiano & McConnell LLP

(57) ABSTRACT

A blank handling device is provided for receiving and firing a blank cartridge for use in a non-gun. The handling device includes a housing having a blank receiving chamber sized and configured for holding the blank during firing. The blank receiving chamber includes a first axis and a first diameter. A gas discharging passageway capable of being coupled to a barrel of a non-gun, is provided that has a second axis and a second diameter. A gas flow passageway is fluidly coupled to and extends between the blank receiving chamber and the gas flow passageway for conducting gasses discharged by the firing of the blank cartridge between the blank receiving chamber and the gas discharging passageway. The gas flow passageway has a third axis and a third diameter. The third diameter is less than the first diameter for preventing the passage through the gas flow passageway of a projectile discharged in the blank receiving chamber.

19 Claims, 13 Drawing Sheets

(56) References Cited

U.S. PATENT DOCUMENTS

| | | | | |
|---|---|---|---|---|
| 8,091,462 | B2 * | 1/2012 | Dueck et al. | 89/14.05 |
| 8,201,487 | B2 * | 6/2012 | Dueck et al. | 89/14.05 |
| 8,763,510 | B2 * | 7/2014 | Dueck et al. | 89/14.5 |
| 2009/0133310 | A1 * | 5/2009 | Wossner et al. | 42/77 |
| 2010/0203483 | A1 * | 8/2010 | Jones et al. | 434/21 |
| 2011/0281243 | A1 * | 11/2011 | Uhr | 434/16 |

* cited by examiner

BLANK CHAMBER AND HOUSING

PRIORITY STATEMENT

The present invention claims benefit of priority to U.S. Provisional Patent Application No. 61/859,831 that was filed on 30 Jul. 2013 and which is fully incorporated herein by reference.

I. TECHNICAL FIELD OF THE INVENTION

The present invention relates to firearm-like devices, and more particularly, to a component of a firearm-like device that is designed for firing non-projectile containing blanks, and that is generally incapable of firing projectile containing live ammunition.

II. BACKGROUND OF THE INVENTION

For the purposes of definition, it is important first to distinguish "guns" and "non-guns". As used in this application, the term "gun" or "firearm" will normally be associated with a device that is capable of firing live ammunition, that results in a projectile being projected out of the barrel of the device. The term "non-gun" or "replica" will be used in this application to denote a device that, although having an appearance of a gun, is not a gun, because of its inability to fire live projectile containing ammunition. Such non-guns are referred to by a variety of terms, such as BFONG (Blank Firing Only Non Gun), NONGUN, BLANK GUN and REPLICA.

Gun ownership carries with it the baggage of not only monetary cost and moral responsibility, but also legal restriction. Owning a gun in many non-US jurisdictions is forbidden. Even within the United States, the ownership of guns is highly regulated, and often may be restricted, or require the gun owner to have a license to own and carry the weapon. Additionally, it is unlawful for persons to own certain types of live ammunition firing guns, and the ownership of other types of firearms is highly restricted. Examples of such banned and/or restricted firearms include certain types of fully automatic guns, machine guns, sawed-off shot guns and the like.

Even if one has complied with all of the necessary paperwork and requirements for owning a gun in his or her jurisdiction, one often runs into difficulties in transporting the guns across state lines. Each of the 50 states each have their own, differing laws and regulations that relate to one's ability to carry a gun, own a gun, and transport a gun through the particular jurisdiction. Additionally, many cities and states have their own regulations that may differ from the regulations and laws in force in the remainder of the state in which the locality resides.

These varied regulations make it difficult for the gun owner to transport his guns, or to travel with a gun. For example, the laws in Illinois very strictly regulate the transportation and carrying of firearms within the state. Therefore, a gun owner, who may wish to transport a gun between Indiana and Missouri is often well advised to travel South through Kentucky and then West into Missouri, rather than taking the straight route through Illinois because of the draconiun penalties associated with carrying and transporting a weapon within the state of Illinois.

Although firearms constitute a major market of products that are desired by a large number of people, there also exists a market for non-guns, that are incapable of firing bullets. One segment of this market includes the market for hobbyist, re-enactors, and another include the film and movie industry. These industries and people participating in these industries and hobbies, often desire to employ a weapon replica that has the appearance and feel of a "real live ammunition firing" firearm. For example, TV and Western movies have long used guns such as Colt revolvers and Springfield rifles, and war movies and re-enactors have often used vintage military rifles, that are appropriate for the conflict in which the re-enactment or film is set.

For those who wish to employ a gun in a "period" event, one avenue for doing so is to obtain an actual vintage weapon that was made and/or used during the particular period. Unfortunately, such vintage weapons are rare, and are often quite valuable. Additionally, a vintage weapon used in a re-enactment or film is still subject to the same laws, restrictions, permits and other problems for which any other like-gun is subject.

Another avenue is to employ a newly made gun that replicates the appearance of the particular historic weapon. Although such modern versions of such vintage guns can often be purchased less expensively than the actual vintage gun they still carry the drawback of imposing on the owner all of the legal requirements, restrictions and problems that are associated with gun ownership.

Therefore, it would be desirable if one could obtain a gun-like device that (1) had the appearance of a real gun; (2) was available at a reasonable price; (3) had the operational characteristics of a real gun, insofar as it could replicate the sounds and/or smoke discharge of a real gun; (4) was relatively safe, but (4) would not qualify as a firearm, and therefore not subject the user to the ownership, transportation and use restrictions, along with the potential liability associated with projectile shooting firearms.

For these reasons, products known as "non-guns" or "blank guns" have been manufactured and sold. Although these "non-guns" can take a variety of shapes and configurations, a particularly vital segment of the market includes those "non-guns" that (1) have the appearance of a real gun; (2) are capable of only firing blanks; and (3) do not qualify as "firearms" and thereby subject the user to the legal and liability issues associated with firearms.

In order to create such a viable non-gun, it is important that the non-gun comply with the applicable, Federal Regulations, so that the non-gun falls outside the definition of a "firearm". Under the Gun Control Act of 1968, a "firearm" is defined to include any weapon (including starter gun) that is designed or may be readily converted to expel a projectile by the action of an explosive . . . [and] . . . the frame or receiver of any such weapon.

As such, a vehicle for removing a device from falling within the definition of a gun or firearm is to design the device so that it will not be capable of firing a projectile, or be easily converted to firing a projectile.

One particular type of gun that is often sought out by those both in the film industry and the re-enacting market, are machine guns. Machine (automatic) guns present a special challenge because they are much more heavily regulated and restricted than single fire and semi-automatic firing guns. Notwithstanding the foregoing, re-enacters and theatrical organizations demand machine guns since machine guns are used extensively in the military, criminal, and other endeavors.

A machine gun is defined by the National Firearms Act as "any weapon that shoots, is designed to shoot, or can be readily restored to shoot automatically more than one shot, without manual reloading by a single function of the trigger. The term shall also include the frame receiver of any such weapon, any part designed and intended solely and exclusively or a combination of parts designed and intended, for use in converting the weapon into a machine gun, and any combination of parts from which a machine gun can be assembled if such parts are in possession or under the control of a person".

It is against this background which the challenge arises for creating a non-gun that has the "functionality" of a machine gun, insofar as its ability to automatically cause the automatic discharge of a series of blanks in a manner analogous to the manner in which a machine gun automatically causes the discharge of ammunition, while still falling within the guidelines provided, or more to the point, which does not fall with the definition of a machine gun.

A firearm that falls outside the guidelines of a "gun" and/or a "machine gun" is classified by the Bureau of Alcohol Tobacco Firearms and Explosives as a non-gun. Once so qualified as a non-gun, the device is largely exempt from the Federal and State Regulations governing guns, making ownership and transport much easier. Although some states do have regulations relating to the ownership and transport of replica guns, most states do not legally regulate them, thus enabling one to own a non-gun and take it from one's home to various re-enactor events, or use one in theatrical productions without the fear of also acquiring significant legal liabilities.

To help distinguish non-guns from live ammunition shooting guns, manufacturers place orange tips on the guns, so that one viewing the gun will know that it is not a real weapon. The use of an orange tip is used with products even as innocuous as water pistols that have the appearance of a real gun to help prevent those who possess such non guns from being mistakenly shot.

It is therefore one object of the present invention to provide a "non-gun" that reliably fires blanks, (as opposed to live ammunition), and which is configured to cause the non-gun to fall outside the reach of Federal Regulations that define and govern firearms, so that the particular device qualifies as a "non-gun" and does not subject the user to the firearms regulations and other burdens imposed on firearms capable of shooting live ammunition.

One way to produce a non-gun that has the appearance and operational characteristics of a projectile shooting "gun", but that still comports with the Federal Requirements and Laws so as to qualify a non-gun, is to modify the receiver of the gun so that the receiver is incapable of firing live ammunition, but restricted to the ability to discharge only blanks.

The "receiver" of a gun is the main frame member portion of the gun that handles the blank (or in a real gun, the bullet). Generally, a gun will include: (1) a stock that the user employs to hold gun; (2) an ammunition storage device that may comprise items such as a cylinder in a revolver, a magazine employed in a pistol such as a 1911-type pistol, or a magazine that one might find in an assault rifle or machine gun; (3) a receiver that handles the projectile as it is positioned in front of the barrel and is fired by the firing mechanism; and (4) a barrel through which the projectile travels when it is discharged by the explosion of the gun powder. The receiver, or "main frame" of the gun includes components such as bolts, firing pins, and a housing for receiving the blank or bullet is the portion of the gun. The assembly of the main frame components are typically referred to as the receiver.

It is therefore another object of the present invention to provide an improved receiver that both enables the non-gun to process the blanks that are being fired therein, through the gun, so that they can be received, positioned for firing, fired and handled after firing, along with processing the byproducts of the firing of the blanks, such as gases, heat, and heat expansion caused by the explosion of the gun powder within the blank. It is also a feature of the present invention that the invention receiver is capable of preventing a live ammunition round from being accidentally discharged through the simulated barrel of the gun.

One feature of a preferred embodiment of the present invention is that it functions well and is tamper resistant. The ability of such a non-gun's components to be tampered with and converted into a gun that is capable of firing ammunition is a quality that will often cause a particular non-gun to lose its designation as a non-gun, and that may cause the non-gun to be subjected to the penalties, structures and regulations attendant to live ammunition shooting firearms.

Another feature of a preferred embodiment of the present invention is to allow the user to adjust the flow of gas between the blank chamber of the non-gun and the barrel of the non gun in order to allow the user to adjust the non-gun for proper operation with different blank loads. This feature has advantage of allowing the user to fine tune the automatic action of simulated firearms with this adjustment to meet his/her needs.

III. SUMMARY OF THE INVENTION

A blank handling device is provided for receiving and firing a blank cartridge for use in a non-gun. The handling device includes a housing having a blank receiving chamber sized and configured for holding the blank during firing. The blank receiving chamber includes a first axis and a first diameter. A gas discharging passageway capable of being coupled to a barrel of a non-gun, is provided that has a second axis and a second diameter. A gas flow passageway is fluidly coupled to and extends between the blank receiving chamber and the gas flow passageway for conducting gasses discharged by the firing of the blank cartridge between the blank receiving chamber and the gas discharging passageway. The gas flow passageway has a third axis and a third diameter. The third diameter is less than the first diameter for preventing the passage through the gas flow passageway of a projectile discharged in the blank receiving chamber.

Preferably, the third axis of the blank handling device extends in a parallel, non-colinear relation with the first axis. Additionally, the third axis should extend in a parallel, non-colinear relationship with the first axis.

In a most preferred embodiment, the third diameter is less than about 0.19 inches, so that it is just slightly larger than a BB. Conversely, the first diameter should be large enough to receive a standard sized blank cartridge, that is usually designed to be similar in size to live fire cartridges, and as such, generally larger than 0.22 inches.

In a most preferred embodiment, the housing member is hardened to achieve a hardness of at least about 55 Rockwell.

One feature of the present invention is that the gas flow passageway is disposed in a parallel, but non-colinear relation with the blank receiving passageway. This non-colinear relation makes it more difficult for the housing of the present invention to either be used with a projectile firing cartridge, or to otherwise be altered to work with a blank firing cartridge.

In a typical gun, the projectile is centered in the cartridge so that it extends along a path that is generally co-linear with the axis of the chamber in which the cartridge is fired. Since in the present invention the passageway is off-center, the gas flow passageway will not receive a projectile well, because of the off-centered relation.

Additionally, it will be more difficult, if not impossible, for the user to convert the blank firing assembly of the present invention into an assembly that is capable of firing live ammunition. One way to convert the blank housing of the present invention into a projectile capable assembly would be to bore out the gas flow passageway so that it had a diameter of at least as large as the projectile being shot through.

In order to make such a conversion, the enlarged gas flow passageway would need to be disposed co-linearly with the blank receiving chamber. The offset nature of the gas flow passageway makes this conversation more difficult, because the enlargement of the gas flow passageway through machining would likely form a gas flow passageway that, even though possibly of the same or greater diameter than the blank containing chamber, would be off center and non-colinear from the blank receiving chamber, and therefore, poorly suited for allowing a projectile to pass there through.

One advantage achieved through this arrangement is that the Applicant's invention provides a blank chamber and chamber housing that is useable with a non-gun, and that enables the non-gun to be both capable of receiving firing blanks, but that is generally incapable of receiving and firing live ammunition.

The blank handling device of the present invention is provided for insertion in and being useable with a non-gun-type device. In addition to the blank handling assembly of the present invention, such a non-gun includes a stock, a barrel and a blank storage unit. The blank handling device of the present invention either comprises a receiver or comprises a part of a larger receiver assembly. The receiver is provided in a non-gun for accepting a blank from the blank storage unit, positioning the blank in an appropriate position within the receiver so that it is positioned for being struck in an appropriate place by the firing pin or other firing mechanism, and then providing a place wherein the blank can be so fired and its gasses discharged.

The receiver comprises the receiver handling device of the present invention that includes a housing. The handler housing has an outer surface that is sized and configured for being received within a particular type of fire arm with which it is designed to be used. The receiver includes a blank receiving chamber for receiving a blank, and holding the blank in a relatively stable position so that the blank can be struck with a discharging use and striker to cause the blank to explosively discharge its load of power and gases. The chamber is disposed generally co-axially with the gas discharging passageway that may comprise a barrel, or may be coupled to a barrel. The gas discharging passageway is generally co-axial with the barrel, and with the blank receiving chamber, although it need not be, since no projectile is being fired through the barrel. The gas flow discharging passageway fluidly couples the blank receiving chamber and the gas flow passageway to each other and can be constructed by forming a wall between the blank receiving chamber and the gas discharging passageway, and then machining or forming a passageway that extends through this wall. The gas flow passageway allows expelled gases to travel through the aperture and into the barrel from the blank receiving chamber.

One feature of the present invention is that the gas flow passageway is sized and positioned so as to not permit a projectile to pass through the gas flow passageway. This feature is achieved through both size consideration and position factors that are engineered into the design of the gas flow passageway. In particular, the size considerations include making the gas flow passageway have a size smaller than any conventional projectiles, to prevent the passage of projectiles through the gas passageway, and hence out the barrel.

Preferably, the receiver frame is made from a hardened material to reduce the ability of the receiver housing to be machined in a manner that would enable the receiver to be tampered with. Preferably also, the receiver housing is welded to other receiver components, so that the receiver housing cannot be removed from the receiver of the gun without causing significant damage to the gun receiver.

Increasing the difficulty of modifying the blank chamber housing to allow for the use of live ammunition is an important feature of the current invention and is very useful for convincing the Bureau of Alcohol and Firearms to treat this device as a non gun. The resistance to modification can be accomplished by any single one, or the combination thereof of features included in the present invention.

In one embodiment of the present invention, the machined blank chamber housing is manufactured in such a way that once the chamber housing has been machined and finished it is treated with hardening process. The hardening of the chamber housing makes it extremely difficult for a user to perform any further machining work on the chamber housing, thus rendering it highly difficult for a user to modify the blank chamber housing.

Another embodiment of the present invention includes a carbide insert strategically placed within the blank chamber housing. The inclusion of a carbide insert adds further protection from modification by disrupting any turning tools which are used in an attempt to modify the blank chamber housing.

Yet another embodiment of the present invention includes an offset gas flow passageway. In a normal live ammunition firing chamber, the barrel is placed colinearly with the bullet receiving chamber to allow the round, or the bullet, to move freely from the chamber through the barrel and to be discharged at the target. In the present invention, there is no need for a bullet to move from the chamber to the barrel, and in fact the prevention of bullet travel is desired. It is therefore not necessary for the chamber and barrel to be directly in line with each other. For these reasons, it may be desirable to offset the gas flow passageway that is in fluid communication between the chamber and the barrel of the non-gun.

One preferred embodiment of the present invention includes an adjustment device positioned between the blank chamber portion and the barrel portion. The adjustment device can be used to adjust the flow of gas from the blank receiving chamber to the barrel thereby allowing the user of the simulated firearm to adjust the gas flow for various blank loads.

One preferred embodiment of the gas flow adjustment device comprises an aperture fluidly connecting the bottom part the blank chamber housing with the gas flow aperture. The gas flow adjustment aperture further comprises a threaded member which can engage a screw member within the aperture. By tightening or loosening the screw, the screw is moved further into or out of the gas flow aperture. As the screw is moved into the gas flow aperture, the gas flow is restricted. As the screw is removed from the gas flow apertura, the gas flow is less restricted. This adjustment mechanism allows the user of the blank firing non gun to fine tune their particular non-gun for the particular blank load that they are using and thereby maximize the realisticness and the function of their blank firing only non-gun.

These and other features of the present invention will become apparent to those skilled in the art upon a review of the drawings and detailed description presented below, that represent the best mode of practicing the invention perceived presently by the Applicant.

IV. BRIEF DESCRIPTION OF THE DRAWINGS

Figure 8A:
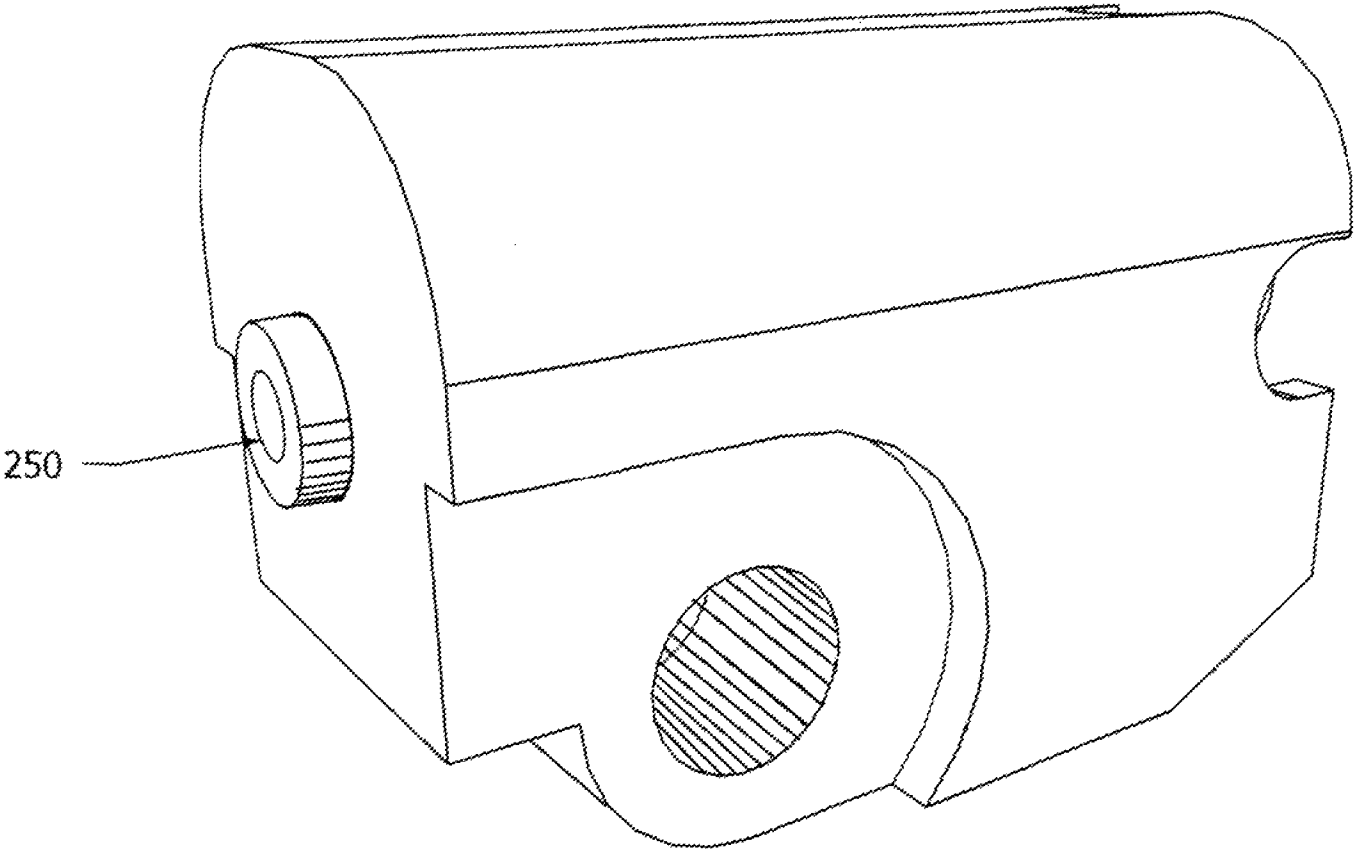
Figure 8B:
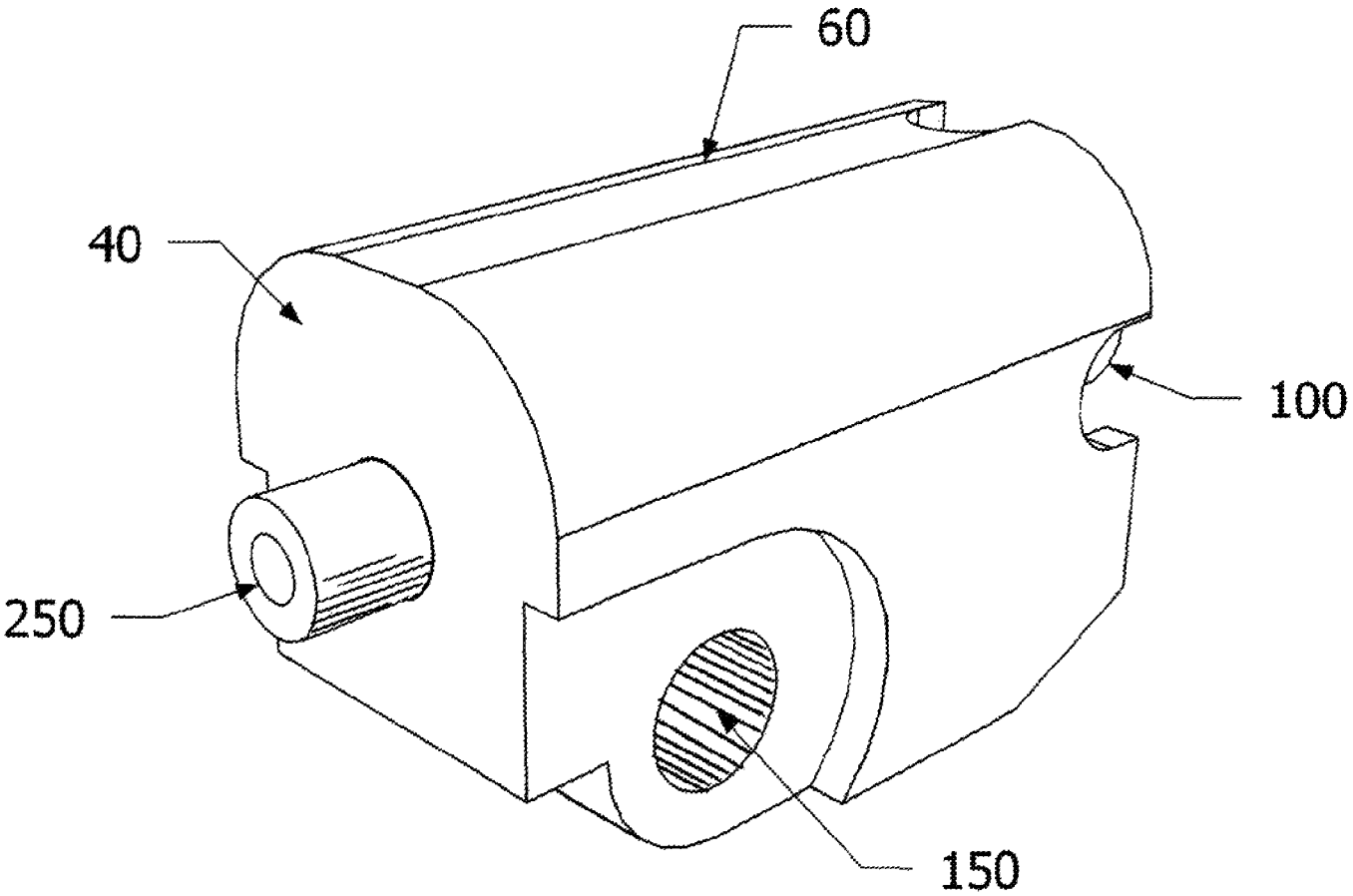
Figure 9:
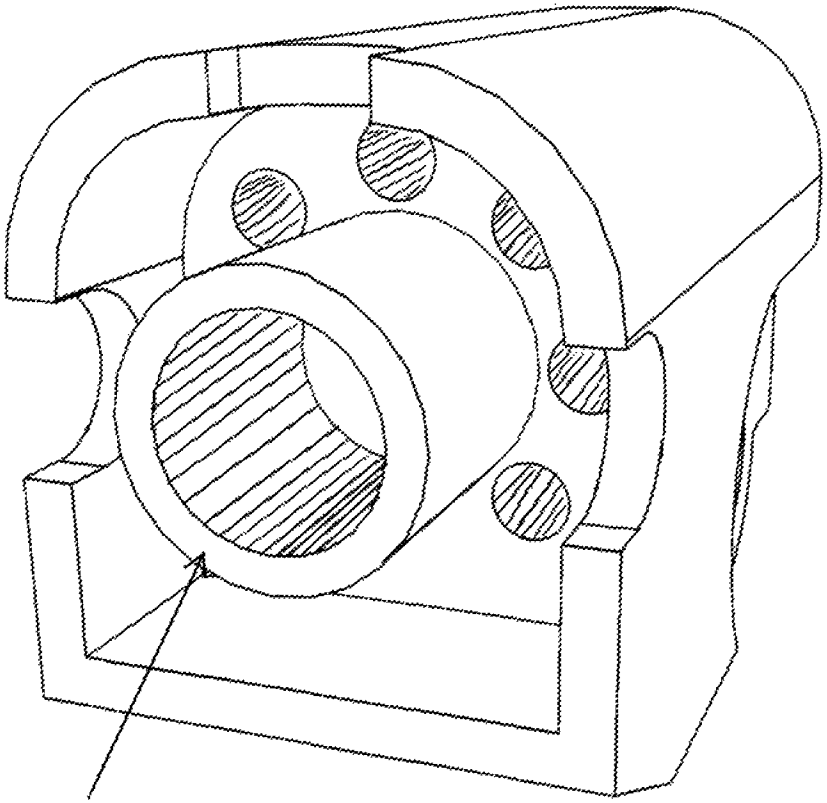
Figure 10:
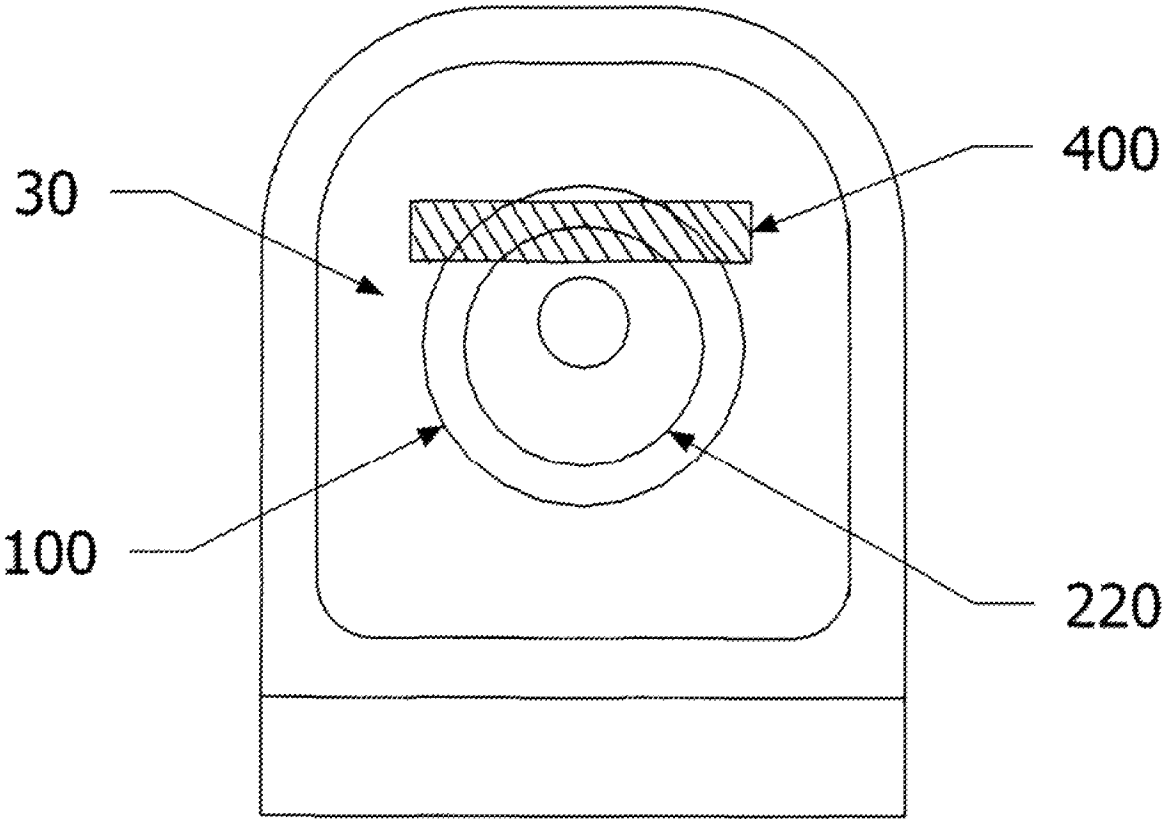
Figure 11:
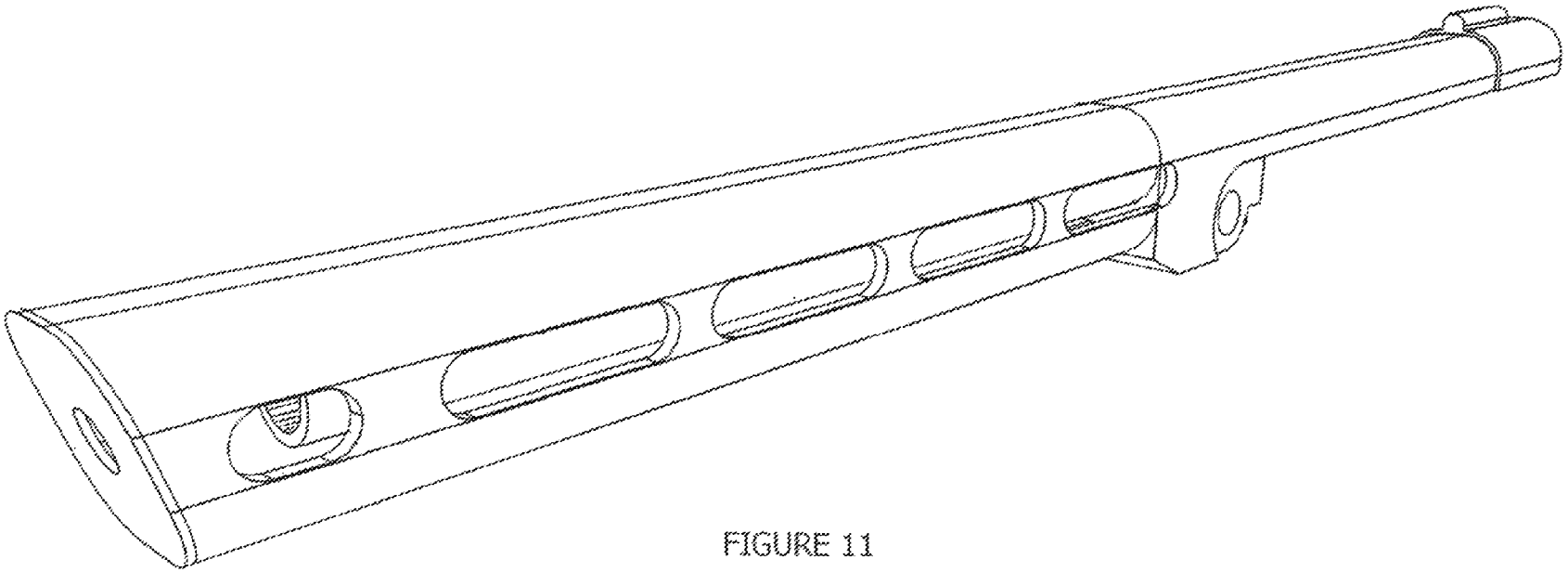

FIG. 8*a* is a perspective view of the blank chamber housing with of the present invention showing a blank fully inserted into the blank chamber;

FIG. 8*b* is a perspective view of the blank chamber housing of the present invention with a blank partially inserted into the blank chamber;

FIG. 9 is a perspective view of the blank chamber housing of the present invention;

FIG. 10 is a front view of the blank chamber housing of the present invention; and FIG. 11 is a perspective view of a blank chamber housing assembled into a complete upper unit of a non-gun;

V. DETAILED DESCRIPTION OF THE PREFERRED EMBODIMENT

Before delving into a description of the present invention, it is useful to review the various components of a typical firearm, to help provide context to the description of the present invention.

Figure 1:
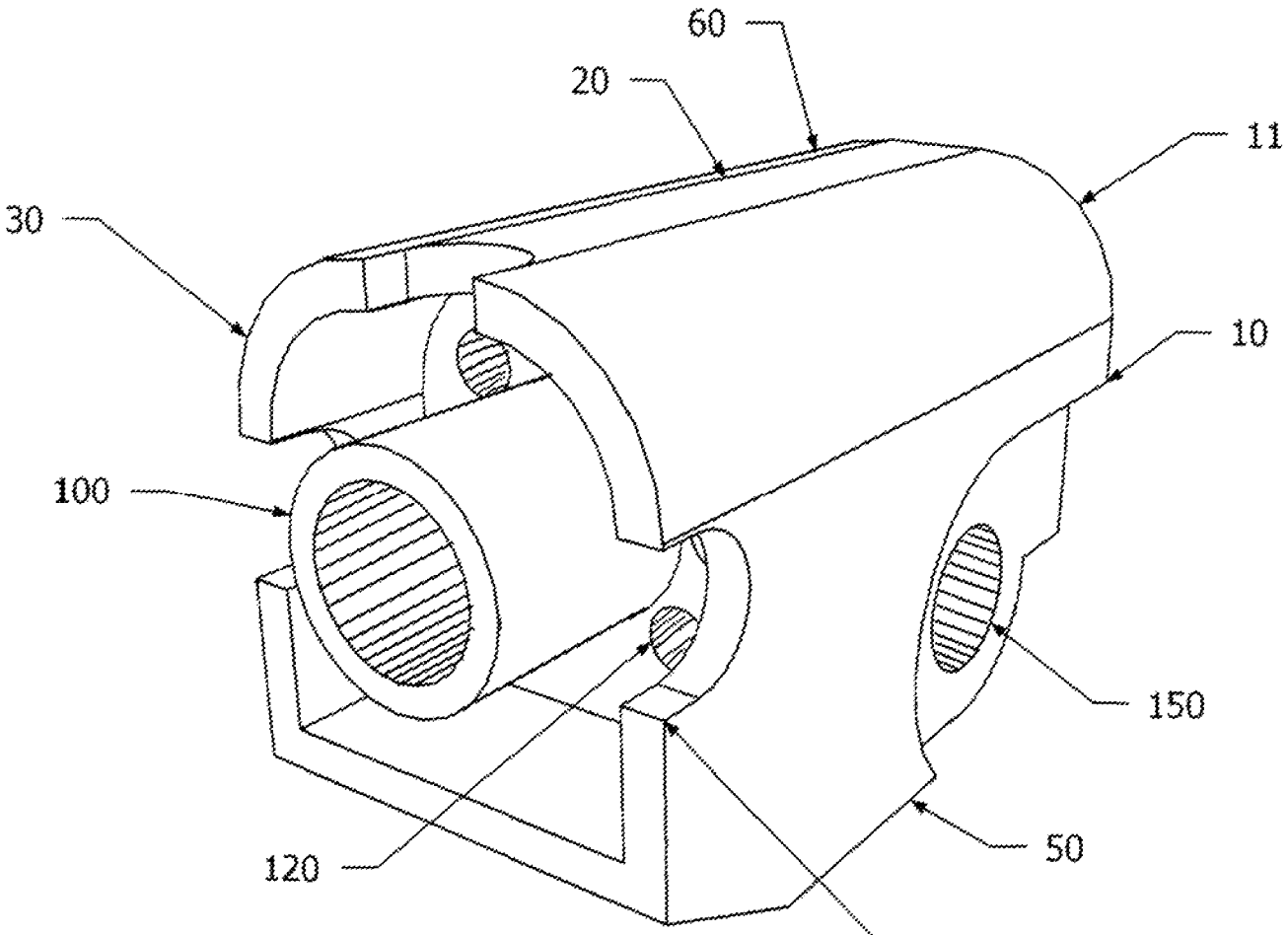
FIG. 1 is a perspective view of the blank handling device (a/k/a receiver housing) of the present invention.
Figure 1A:
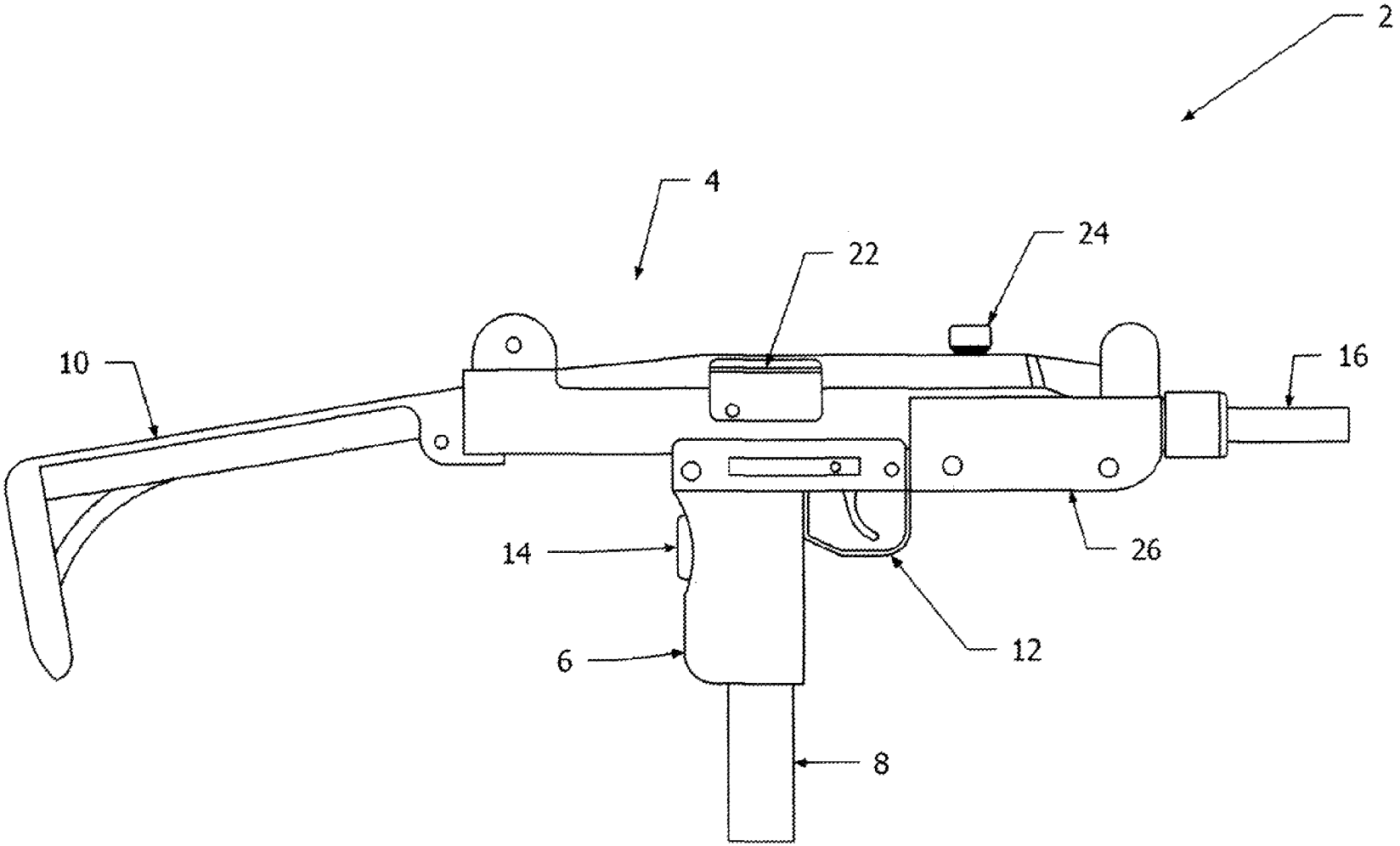
FIG 1A PRIOR ART
FIG. 1A is a side view of a prior art projectile firing weapon.
Figure 2:
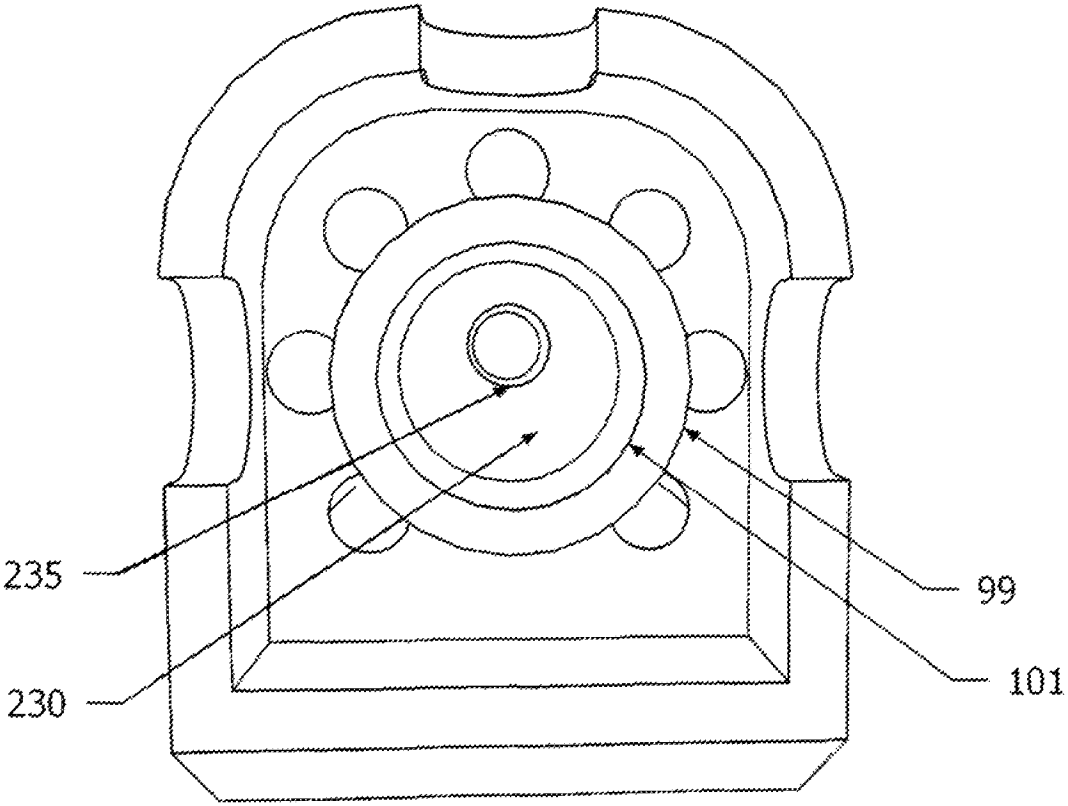
FIG. 2 is a front view of the blank handling device of the present invention.

In FIG. 1A, a schematic drawing of a prior art weapon is shown. In particular, the weapon shown in FIG. 1A is an Uzi submachine gun that is the subject of U.S. Pat. No. 4,335,643, that issued on 22 Jun. 1982. The description of the machine gun and the manner in which it operates is incorporated herein by reference.

The machine gun 2 shown in FIG. 1A includes an elongated receiver 4, that generally contains the various springs, bolts, slides, etc., that handle the passage of a cartridge and passage from a magazine, to the receiver and then upon ejection from the gun. Although the weapon 2 shown in FIG. 1A is a "gun" capable of firing projectiles, it will be appreciated that the feature described in connection with the Uzi submachine gun 2 of FIG. 1A could be common with a blank non-gun of the present invention, as the primary differences between the blank non-gun of the present invention and the Uzi submachine gun shown in the prior art are contained within the receiver of the present invention that is not shown, and is internal to the gun. As alluded to above, the exterior component shown in the weapon 2 of FIG. 1A might be desirable to use in connection with the housing and blank handling device of the present invention, because the use of the blank handling device of the present invention with parts that have an appearance similar to those of the weapon 2 shown in FIG. 1A would have a very realistic appearance, and would be useful to one who is a re-enactor or participant in the theatrical production, wanted to have a non-gun for use that had an appearance similar or identical to an Uzi submachine gun. The weapon 2 further includes a pistol grip 6 that extends downwardly from the receiver 40 and forms a housing for a conventional cartridge, magazine or clip 8. A trigger mechanism 12 is disposed forwardly of the pistol grip 6. A grip safety 14 is disposed on the rear side of the pistol grip 6. A barrel 16 is fixedly coupled in fluid communication with a chamber of the receiver 4. An extensible and retractable stock 22 is coupled on the butt or proximal end of the weapon 2, and a firing mechanism indicated generally at 22 is also disposed internally within the gun. A manual cocking knob 24 is also provided along with a fore stock 26 that provides a convenient handle for the user.

Other patents that provide good descriptions of alternate automatic gun mechanisms and operations are shown inter alia in Thompson, U.S. Pat. No. 1,425,810; Eickhoff, U.S. Pat. No. 1,396,949; and Norman, U.S. Pat. No. 2,053,489. Disclosures of these patents are incorporated herein by reference, to the extent that these references describe the operation and components of a firearm, or include components that could be used with the novel, present invention.

Turning first to FIG. 1, a perspective view of the blank housing 10 of a blank handling device 11 is shown from the gas discharge (or barrel) end of the blank housing 10. The blank chamber housing 10 is preferably formed from a single block or billet of metal, such as steel or an alloy of steel. A particularly useful steel would be a machinable steel that is machinable steel such as 1018 mild steele. As will be discussed in more detail below, the housing 10 is hardened such as by heat-treating after being machined to make it more tamper resistant. However, during the machining operations, one might prefer a machinable steel that is not yet hardened so that it is soft enough for easy machining.

The housing 10 includes an outer surface 20. The outer surface 20 is sized, shaped and configured to fit within its appropriate position in the receiver of the blank firing non gun not shown (e.g. 2) into which it is being installed. It will be appreciated that the particular size, shape and configuration of the outer surface 20 of the housing 10 will largely be dictated and governed by the particular non-gun into which it is being installed, and will differ from non-gun to non-gun. Nonetheless, the general shape of housing 10 shown in FIG. 1 is a shape, that within broad parameters, is similar to the appearance that many other housings 10 for many other models of non guns, and in particular, machine gun type non-guns will likely assume. The external profile will change depending upon the particular model of non-gun for which housing 10 is intended to be used.

The housing 10 also includes a first end and a second end, that will be designated herein as the proximal end 40 and the distal end 30. The proximal end 40 is the end of the housing 10 that is disposed closest to the stock 18 of the non-gun (not shown), and the distal end 30 is the end of the receiver 30 that is closest to the barrel 16 of the non-gun 2 and the distal end of the non-gun 2 into which the receiver housing 10 is placed.

In most receiver housings 10, it is expected that the proximal 40 and distal 30 ends will generally be planar in configuration. As shown in the figures, a receiver housing 10 of the present invention also includes an integrated chamber housing, that includes a blank receiving chamber 200 that opens onto the proximal end 40 of the receiver housing 10. The blank receiving chamber 200 is sized and configured for holding the blank (not shown) during firing so that it may be struck appropriately by the firing mechanism, such as a firing pin of the non-gun 2. As blanks generally approximate the diameter of live ammunition, and also, sometimes the length of live ammunition, the blank chamber should have a diameter and a length sized for receiving appropriate sized blanks. Because of this, one embodiment of the blank receiving chamber would have a diameter of greater than about 0.22 inches, so that it can receive a 22 caliber blank. The blank chamber has a first diameter 104 (FIG. 3) and a first axis 106 that extends in a proximal distal direction at the center of the blank chamber.

Figure 3:
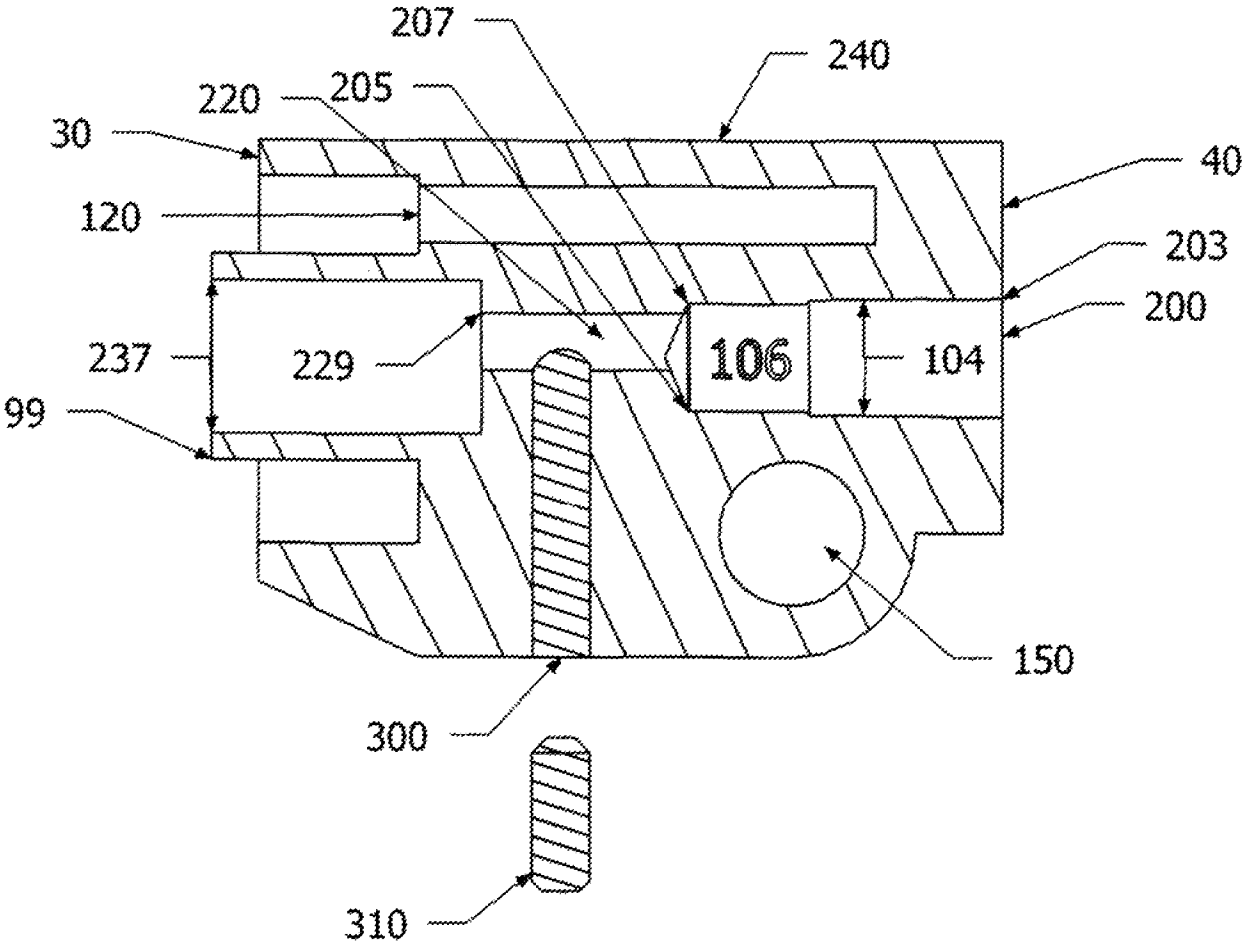
FIG. 3 is a sectional view taken along lines 3-3 of FIG. 2.
Figure 4:
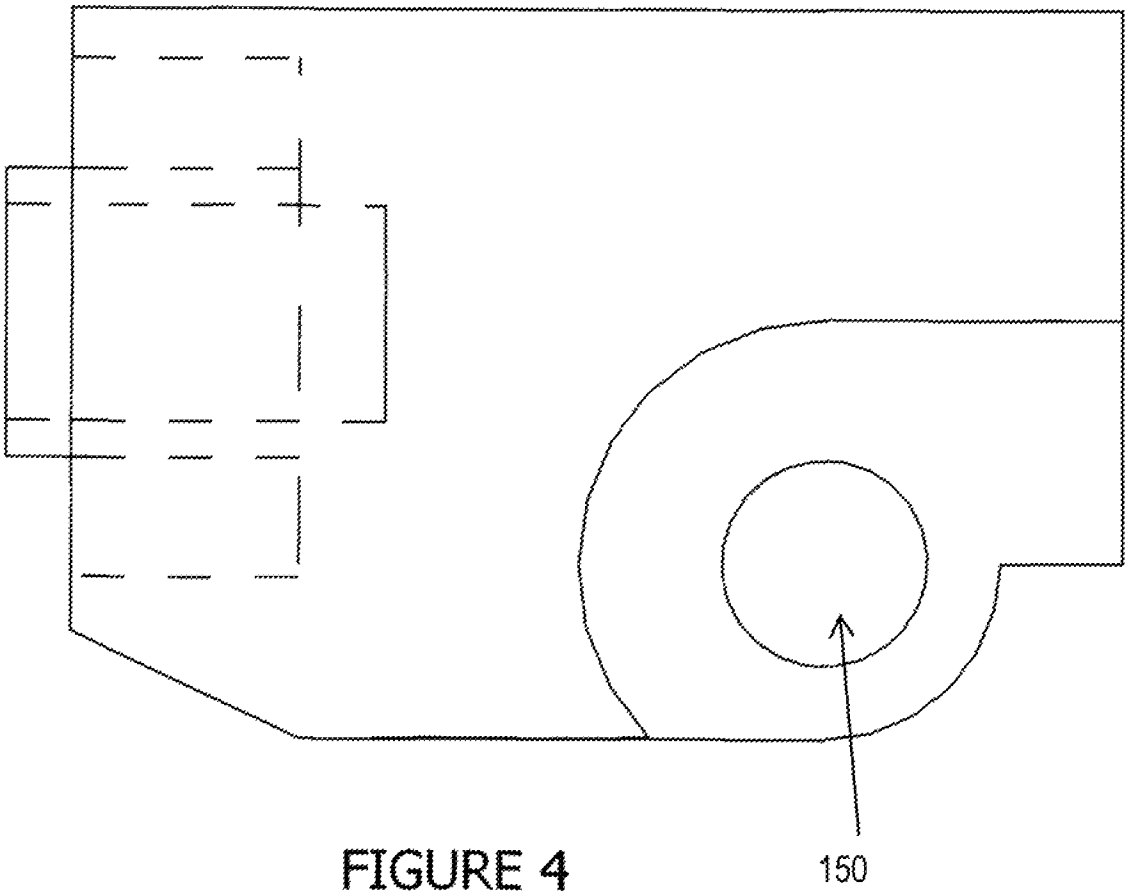
FIG. 4 is a side view of the blank handling device housing of the present invention.
Figure 5:
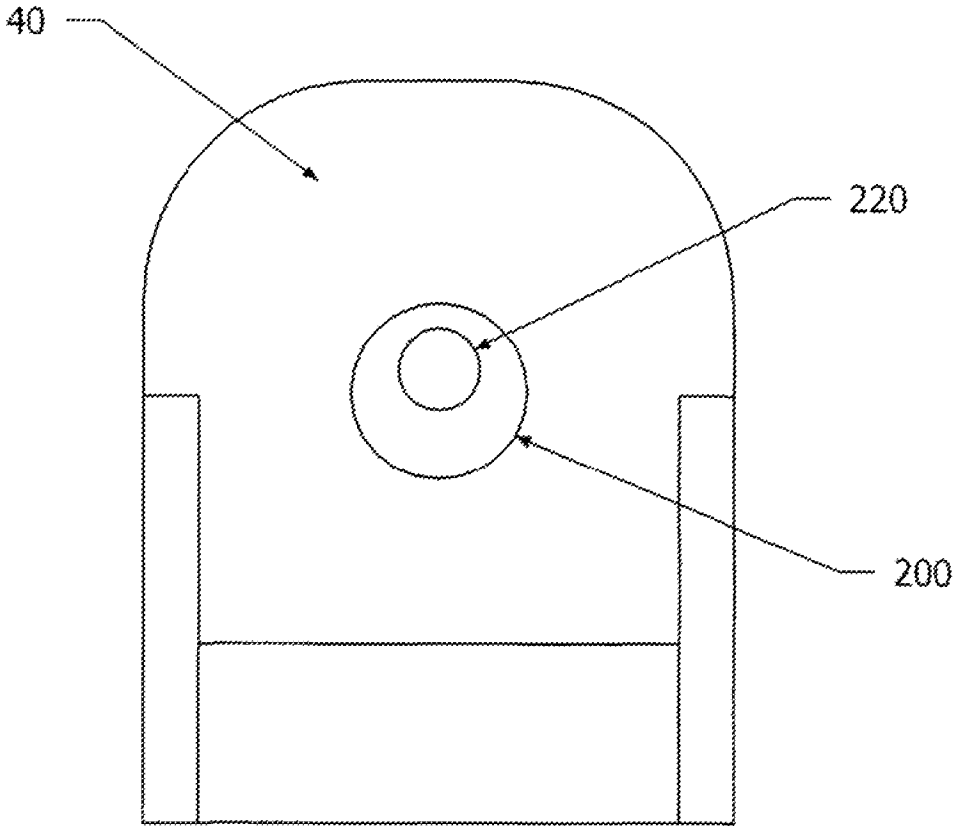
FIG. 5 is a rear view of the blank handling device housing of the present invention.
Figure 6:
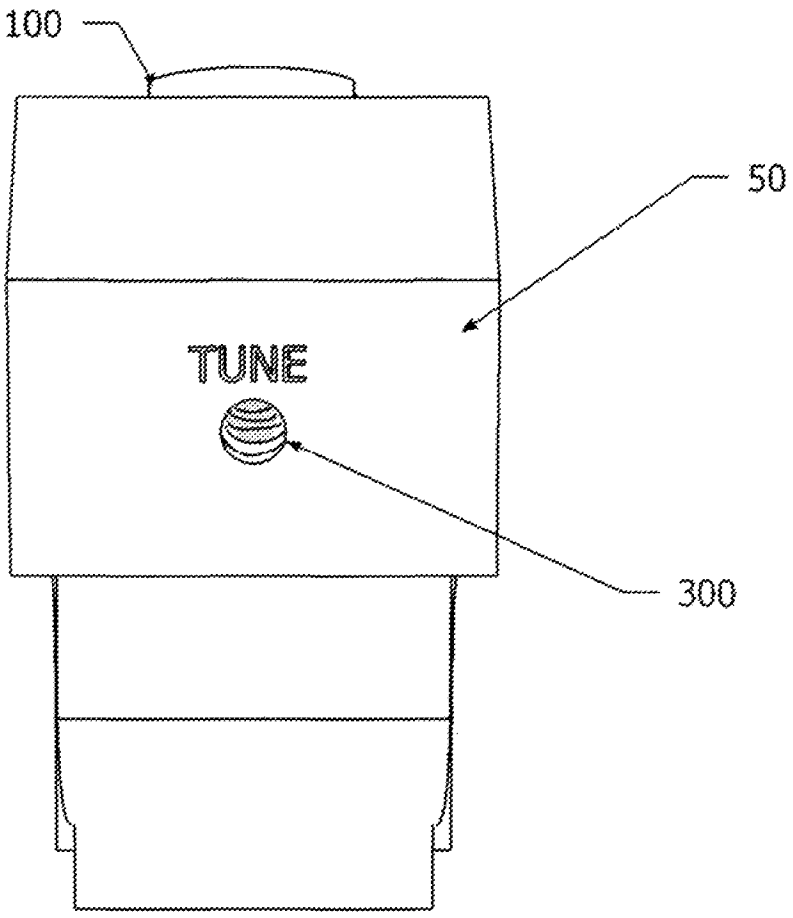
FIG. 6 is a bottom view of the blank handling device housing of the present invention.
Figure 7:
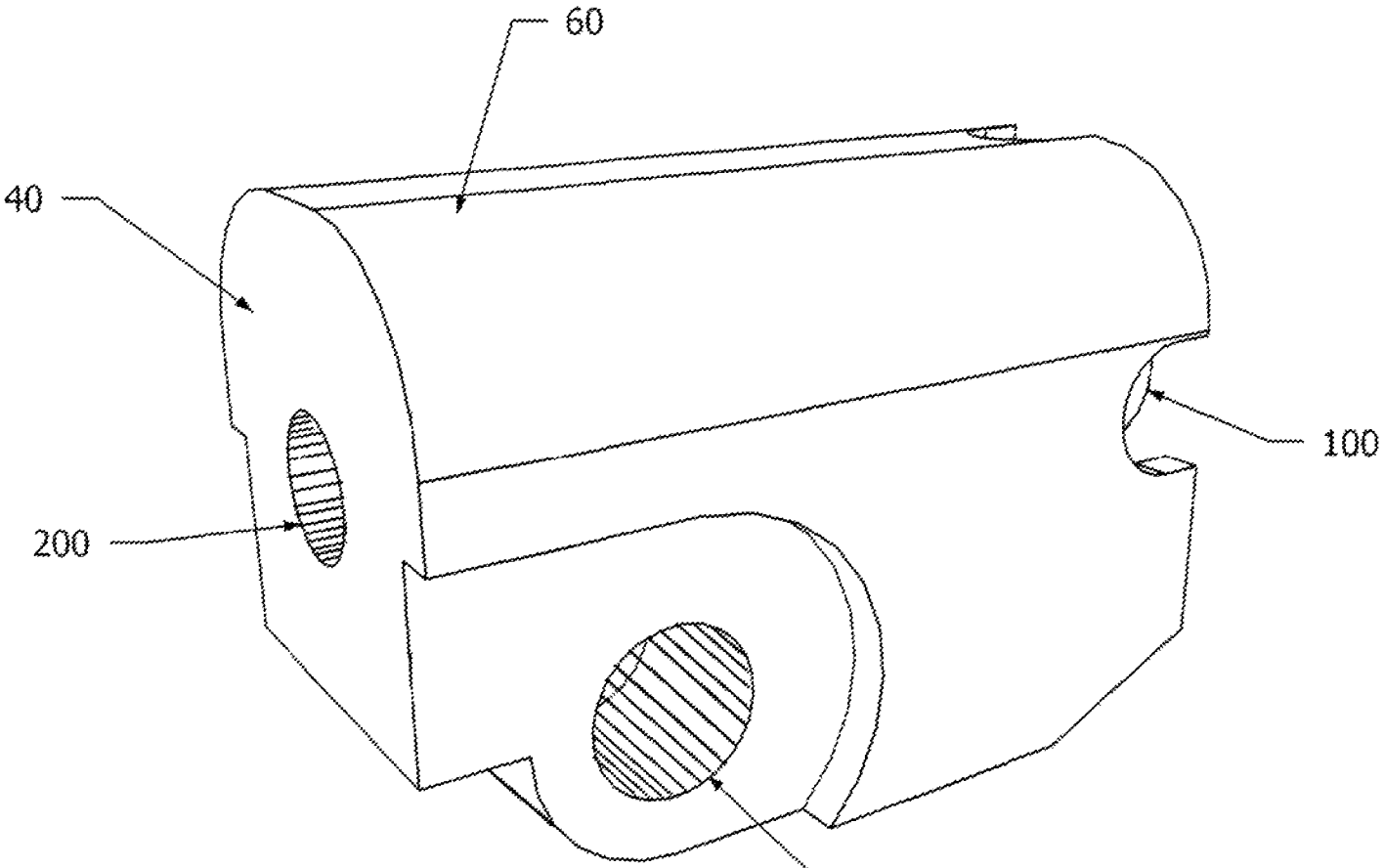
FIG. 7 is a perspective view of the blank handling device housing of the present invention.

As best shown in FIG. 3, the blank receiving chamber 200 includes a proximal end 203 that comprises the chamber opening at the proximal end 40 of the receiver housing 10, and a distal end 205 that terminates at the aperture-containing wall portion 207 of the receiver. The blank receiving chamber 200 is generally cylindrical in configuration to mate with the generally cylindrical configuration of most blanks. The diameter 104 and the length of the blank receiving chamber 200 will vary with the diameter 104 and length of the blank the chamber 200 is designed to receive. One vehicle that is employed in one embodiment of the present invention, is to size the chamber 200 in a manner so that it will not readily accept live ammunition. This is accomplished by sizing the diameter 10 of the cartridge so that it will receive blank cartridges, but not live ammunition or by selecting a shoulder angle 207 that is incompatible with live ammunition. Typically, live ammunition has a diameter at its base that is larger than the diameter of the base of a blank cartridge. By sizing the diameter of the blank receiving chamber to fit only a blank, live ammunition cannot be used, because one inserting live ammunition within the chamber 200 would be in a position where the live ammunition would likely not be inserted far enough into the chamber 200 to enable the bolt to function appropriately, thus causing the brass casing to rupture, as the length of live ammunition member that extended out of the end of the chamber 200 would interfere with the proper function of the firing action of the non-gun.

The distal end 30 of the receiver housing 10 includes a barrel receiving portion 100. The barrel receiving portion 100 includes a tube member 99 that includes an inner surface 101 that defines a cylindrical gas discharging passageway 230. The gas discharging passageway 230 has an axis (second axis) 231 and a diameter (second diameter) 233. The inner diameter 231 should be between about 0.15 and 0.25 inches, and is preferably sized so that the second diameter 231 of the gas discharge passageway 230 is smaller than the first diameter 104 of the blank chamber 200. The gas discharge passageway's second axis, the tube member, is sized and positioned to receive the proximal end of the barrel. Preferably, the proximal end of the barrel is welded onto the distal end of the tube 99. By welding the barrel onto the distal end of the tube 99, one accomplishes several useful features. First, one makes the device more tamper proof, because one cannot easily remove the barrel from the receiver housing 10 and thereby perform machining or other services on the receiver housing 10. Secondly, by welding the barrel onto the tube 99, one reduces the likelihood of gases escaping between the juncture of the barrel receiving tube 99 and the barrel itself that can occur with barrels that are threadedly attached to a receiver housing.

In a normal gun, it might be useful to incorporate a removable barrel to facilitate repair and/or replacement of the barrel if the barrel becomes damaged or overused or falls out of specification. However, since no projectile in a non-gun ever passes through the barrel of the non-gun of the present invention, such issues are highly unlikely to arise.

A plurality of cooling apertures or passageways 120 may be drilled into the solid block receiver housing 10 to reduce weight and also enhance cooling.

A wall member 240 is formed between the blank receiving chamber 202 and the barrel receiving gas discharge passageway 230. The wall 240 defines a gas flow passageway 220 that is fluidly coupled to and extends between the blank receiving chamber 200 and the gas discharging passageway 230 for conducting gasses discharged by the firing of the blank cartridge between the blank receiving chamber 100 and gas discharging passageway 230. The gas flow passageway has a third axis 225 and a third diameter 229. The third diameter 229 is less than the first diameter 104 for presenting the passage through the gas flow passageway 220 of a projectile discharged in the blank receiving chamber 200.

The axis 225 of the gas flow passageway is parallel, but not colinear with either the axis 106, 235 of the blank receiving chamber 200 and the gas discharge passageway 230. The gas flow passageway 220 is designed to have a diameter 227 that is less than the diameter 104, 237 either the blank receiving chamber 200 or the gas discharging passageway 230. Preferably, the diameter 227 of the gas flow passageway 220 of less than about 0.19-0.21 inches, thereby be sufficiently small so as to not enable a typical bullet projectile to pass therethrough. Additionally, the axis 225 of the gas flow passageway 220 is designed to be non-colinear with the axis of the blank receiving chamber 200 and the gas discharge passageway 230, so that if a projectile even one having a small enough diameter in the chamber 200, the projectile would not pass through the gas flow passageway 220 because the passageway 220 would be off center, thus causing the bullet to not pass through the passageway 220 because of the off centered positioning.

FIG. 3 shows a sectional view of the blank chamber housing 10. The proximal end 40 of the blank chamber housing 10 contains the blank receiving chamber 200. The distal end of the housing contains the gas discharge passageway 230. The gas discharge passageway 230 and the blank receiving chamber 200 are separated by the separating wall 240. The gas discharge chamber 230 and the blank receiving chamber are in fluid communication by way of the connecting gas flow passageway 220.

The flow of gas between the two apertures can be restricted by the use of the tuning port screw 310. Turning port screw is threadedly engaged into a threaded tuning passageway 300 that has an axis generally perpendicular to the axis of 225 of the gas flow passageway. The tuning screw 710 extends in the threaded tuning passageway 310 far enough so that the distal tip of the tuning screw can extend into the gas flow passageway 220. When so positioned in the gas flow passageway 220, the tuning screw can effectively vary the cross-sectional area of the gas flow passageway 220 to thereby enable to adjust the gas flow resistance in the gas flow passageway 220.

Turning now to FIG. 10 you will see a view of the blank chamber housing 10 from the distal gas discharge end 30. Adjacent to the gas transfer aperture 220 is a Carbide Insert feature 400. The carbide insert 400 comprises a carbide member having a significant hardness that thereby makes it resistant to machining and thereby further limits the ability of a user from attempting to modify the blank chamber housing 10 to fire live ammunition by expanding the diameter of the gas flow passageway to accommodate the passage of live ammunition there through. The Carbide Insert 400 is inserted adjacent to the gas transfer aperture 220 in such away as to disrupt any turning tool that is used in an attempt to enlarge the gas transfer aperture 220.

Having described the invention in detail with respect to certain preferred embodiments, it will be appreciated that variations and modifications exist within the scope and spirit of the invention as defined herein by the appended claims, and their equivalents and the prior art.

What is claimed is:

1. A blank handling device for receiving and firing a blank cartridge for use in a non-gun, the handling device comprising:

a housing having a linearly extending rearwardly disposed blank receiving chamber sized and configured for holding the blank during firing, the blank receiving chamber including a first axis and a first diameter, a linearly extending forwardly disposed gas discharging passageway capable of being coupled to a barrel of a non-gun, the barrel receiving passageway having a second axis generally co-linear with the first axis and a second diameter, and a linearly extending gas flow passageway fluidly coupled to and extending between the blank receiving chamber and the gas discharging passageway for conducting gasses discharged by the firing of the blank cartridge between the blank receiving chamber and the gas discharging passageway, the gas flow passageway having a third axis parallel with, but not co-linear with the first and second axes and a third diameter, wherein the third diameter is less than the first diameter for preventing the passage through the gas flow passageway of a projectile discharged in the blank receiving chamber, wherein the blank receiving chamber, glass flow passageway and gas discharging passageway are positioned to permit a unidirectional flow of gas from the blank cartridge, through the blank receiving chamber, through the gas flow passageway, and through the gas discharging passageway.

2. The blank handling device of claim 1 wherein the first diameter is at, least about 0.22 inches, and the third diameter is less than about 0.22 inches and the third diameter is between about 0.18 inches and 0.25 inches.

3. The blank handling device of claim 2 wherein the first diameter is at least as large as about 0.22 inches and the third diameter is less than about 0.22 inches.

4. The blank handling device of claim 2 wherein the second diameter is at least about 0.20 inches, but less than the first diameter.

5. The blank handling device of claim 2 wherein the housing comprises a hardened metal housing.

6. The blank handling device of claim 5 wherein the housing is hardened to achieve a hardness of at least about 55 Rockwell.

7. The blank device of claim 1 wherein the housing includes a barrel coupler for permitting a barrel to be coupled to the housing in a manner wherein an axis of the barrel is disposed colinearly with the second axis.

8. The blank handling device of claim 1 wherein the third diameter is less than the second diameter.

9. The blank handling device of claim 8 wherein the housing includes a barrel coupler for permitting a barrel to be coupled to the housing in a manner wherein an axis of the barrel is disposed colinearly with the second axis.

10. The blank handling device of claim 1 wherein the gas flow passageway includes an adjustable restrictor to allow for the variable restriction of flow of gasses between the blank receiving chamber and the gas discharging passageway.

11. The blank handling device of claim 10 wherein the adjustable restrictor comprises an adjustable screw.

12. The blank handling device of claim 1 further comprising a carbide insert is fixedly attached adjacent to the gas flow passageway, the carbide insert being positioned outside of the third diameter of the gas flow passageway, but at least partially inside the third diameter of the blank receiving chamber.

13. The blank handling device of claim 1 wherein the gas discharging passageway is coupled to a receiver section by a welded joint.

14. The blank handling device of claim 1 wherein the gas discharging passageway is coupled to a barrel section by a welded joint.

15. A blank handling device for receiving and firing a blank cartridge for use in a non-gun, the handling device comprising:

a hardened housing having a linearly extending, rearwardly disposed blank receiving chamber sized and configured for holding a forward facing blank cartridge during firing, the blank receiving chamber including a first axis and a first diameter, a gas discharging passageway capable of being coupled to a barrel of a non-gun, the barrel receiving passageway having a second axis generally co-linear with the first axis, and a second diameter, a linearly extending gas flow passageway fluidly coupled to and extending between the blank receiving chamber and the gas discharging passageway for conducting gasses discharged by the firing of the blank cartridge between the blank receiving chamber and the gas discharging passageway, the gas flow passageway having a third axis generally parallel with each of the first and second axes, but not co-linear with the first and second axes, and a third diameter, a gas flow restricter for adjusting the flow of gas between the blank receiving chamber and the gas discharge port, and a carbide insert fixedly attached to a position adjacent to the gas flow passageway for increasing the difficulty of enlarging the third diameter of the gas flow passageway.

16. The blank handling device of claim 15 wherein the carbide insert is positioned outside the third diameter of the gas passageway, but inside the diameter of the first diameter of the blank receiving chamber.

17. A blank handling device for receiving and firing a blank cartridge for use in a non-gun, the handling device comprising:

a receiver having a hardened housing including a non-separable blank receiving portion, gas discharging portion and a gas flow portion non-separably joined to and positioned between the blank receiving portion and the gas discharging portion, the blank receiving portion for receiving a forward facing blank cartridge, including a linearly extending rearwardly disposed blank receiving chamber sized and configured for holding a forward facing blank cartridge during firing, the blank receiving chamber including a first axis and a first diameter, the gas discharging portion including a linearly extending forwardly disposed gas discharging passageway capable of being coupled to a barrel of a non-gun, the barrel receiving passageway having a second axis generally co-linear with the first axis and a second diameter, and the gas flow portion including a linearly extending gas flow passageway fluidly coupled to and extending between the blank receiving chamber and the gas discharging passageway for conducting gasses discharged by the firing of the blank cartridge between the blank receiving chamber and the gas discharging passageway, the gas flow passageway having a third axis parallel with, but not co-linear with the first and second axes and a third diameter, wherein the third diameter is less than the first diameter for preventing the passage through the gas flow passageway of a projectile discharged in the blank receiving chamber, and wherein the blank receiving chamber, glass flow passageway and gas discharging passageway are positioned to permit a unidirectional flow of gas from the blank cartridge, through the blank receiving chamber, through the gas flow passageway, and through the gas discharging passageway.

18. The blank handling device of claim 17 wherein the non-separable blank receiving portion is disposed rearwardly of the gas flow portion, the gas discharging portion is disposed forwardly of the gas flow portion, and the gas flow portion is disposed entirely between the blank receiving portion and the gas discharging portion.

19. The blank handling device of claim 17 wherein the gas flow portion is non-separably joined to the gas discharging portion, and the blank receiving portion through a welded joint.

* * * * *